United States Patent [19]

Effle

[11] Patent Number: 4,856,112

[45] Date of Patent: Aug. 15, 1989

[54] POWDER CUFF

[76] Inventor: Michael D. Effle, 2140 W. Thuderbird, Apt. #3126, Phoenix, Ariz. 85023

[21] Appl. No.: 50,420

[22] Filed: Jun. 4, 1987

[51] Int. Cl.[4] ..... A41D 13/08

[52] U.S. Cl. ..... 2/59; 2/16

[58] Field of Search ..... 2/16, 59

[56] References Cited

U.S. PATENT DOCUMENTS

| | | | |
|---|---|---|---|
| 1,284,536 | 11/1918 | Yaeger | 2/59 |
| 1,949,773 | 3/1934 | Amend et al. | 2/59 |
| 2,059,136 | 10/1936 | Moller | 2/59 |
| 2,459,992 | 1/1949 | Cimino | 2/59 |
| 3,329,143 | 7/1967 | Gorden | 2/59 |
| 3,657,741 | 4/1972 | Blanco | 2/59 |
| 4,287,608 | 9/1981 | Meyer | 2/16 |

FOREIGN PATENT DOCUMENTS

| | | | |
|---|---|---|---|
| 128715 | 1/1929 | Switzerland | 2/59 |
| 287546 | 5/1928 | United Kingdom | 2/59 |

*Primary Examiner*—Henry S. Jaudon
*Assistant Examiner*—Jeanette E. Chapman
*Attorney, Agent, or Firm*—Tod R. Nissle

[57] ABSTRACT

Protective clothing for preventing snow from penetrating between the glove and coat sleeve being worn on the hand and arm of an individual. The protective clothing can readily be placed on and removed form the arm of an individual by using the gloved hand of the other arm of the individual.

6 Claims, 2 Drawing Sheets

POWDER CUFF

This invention relates to clothing for protecting an individual when the individual is out-of-doors in cold, snow covered terrain.

More particularly, the invention relates to clothing which prevents snow from penetrating between the glove and coat sleeve being worn on the hand and arm of an individual.

In a further respect, the invention relates to protective clothing of the type described which can readily be placed on and removed from the arm of an individual by using the gloved hand of the other arm of the individual.

Gloves and coats are customarily worn by individuals working out-of-doors in cold, snow covered terrain. While such clothing has long been utilized to generally effectively protect an individual in snow covered areas, if the individual falls, for instance while skiing, or is working his way through snow covered underbrush, snow often penetrates through the space between the glove and coat sleeve being worn by the individual. The snow then melts against the skin beneath the glove and the coat sleeve and greatly facilitates frost bite and freezing of the skin, particularly in extremely cold weather conditions. Members of ski patrols and other professional, highly trained out-of-doors safety organizations often travel in inclement weather and appreciate the importance of preventing snow, especially "powder" snow, from contacting and melting on skin underneath protective clothing. At the same time, such professionals, as well as amateur skiers and outdoorsmen, realize the critical importance of clothing which can be readily put on and removed with the hands while gloves are worn on the hands. Auxiliary winter clothing which can be put on and removed by an individual only when gloves are not being worn by the individual is inconvenient and, when such winter clothing must contact and be utilized in conjunction with gloves, is totally impractical.

Accordingly, it would be highly desirable to provide improved snow-terrain protective clothing which would prevent snow, especially fine granules of powdery snow, from penetrating the space between the coat sleeve and glove on the arm and hand of an individual and which could be readily put on and removed using a single gloved hand.

Therefore, it is a principal object of the invention to provide improved clothing for protecting an- individual from frostbite and cold when the individual is traveling out-of-doors in cold, snow covered terrain.

Another object of the invention is to provide improved protective clothing which prevents snow from penetrating between the glove and coat sleeve worn on the hand and arm of an individual and which, consequently, prevents snow from contacting the skin and melting intermediate the glove and skin of an individual.

A further object of the invention is to provide improved protective clothing of the type described which can be put on and removed from the arm and hand of an individual using a single gloved hand.

Still another object of the instant invention is to provide improved snow-terrain protective clothing which is secured on the person by utilizing fastening means which can be manually operated using a single gloved hand and which is generally operable even when snow is compacted and freezes against the fastening means.

These and other, further and more specific objects and advantages of the invention will be apparent to those skilled in the art from the following detailed description thereof, taken in conjunction with the drawings, in which.

Briefly, in accordance with my invention, I provide an improved sleeve for preventing snow from penetrating between the glove and the coat sleeve worn on the hand and arm of an individual. The sleeve includes a snow impervious tubular portion of extended length having outer and inner surfaces and adapted to cover the glove and coat sleeve of an individual from the wrist to one of a position below the elbow and a position above the elbow; wrist engaging means on g one-end of said tubular portion for gripping the glove about the individual's wrist; arm engaging means on the other end of the tubular portion for gripping the coat sleeve about the individual's arm at one of a position below the elbow and and position above the elbow and holding the tubular portion extended along the forearm; a longitudinal split extending from the other end partially toward said one end; and, means for detachably closing said split. The securing means can be readily manually operated with a single gloved hand. The securing means can comprise zipper means readily manually operated with a gloved hand and resistant to binding and corroding when snow is compacted thereagainst.

In another embodiment of my invention, I provide a method for preventing snow from penetrating beneath the glove and coat sleeve worn on the hand and arm of an individual. The method comprises the steps of pulling a sleeve over the hand and arm of the individual, the sleeve including a snow impervious tubular portion of extended length having out and inner surfaces and adapted to cover the glove and coat sleeve from the wrist to one of a position below the elbow and a position above the elbow, wrist engaging means- on one end of said tubular portion for gripping the glove about the individual's wrist, arm engaging means on the other end of the tubular portion for gripping the coat sleeve about the individual's arm at one of a position below the elbow and a position above the elbow and holding the tubular portion-. extended along the forearm, an open longitudinal split extending from the other end partially toward the one end, and means for manually closing the longitudinal split; positioning the sleeve with the wrist engaging means gripping the glove about the individual's wrist; and, manually operating the closing means to close the longitudinal split.

Figure 1:
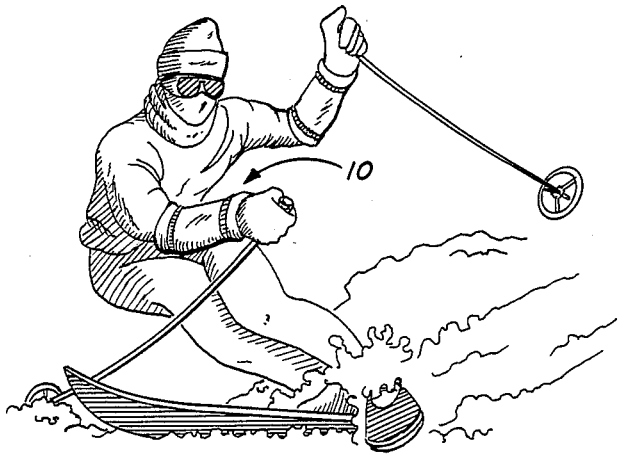
FIG. 1 is a perspective view illustrating a skier equipped with snow-terrain protective clothing fabricated in accordance with the principles of the invention.
Figure 2:
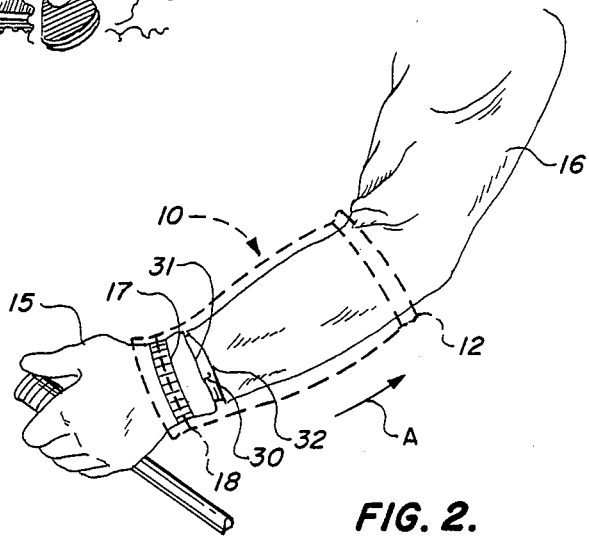
FIG. 2 is a side view illustrating a ghost view of snow-terrain protective clothing of the invention mounted on the glove and coat sleeve of a skier.
Figure 3:
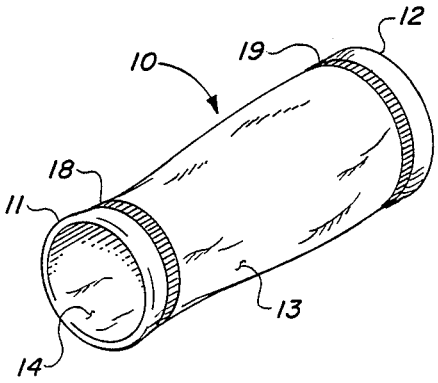
FIG. 3 is a perspective view illustrating one embodiment of the snow-terrain protective clothing of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 3 illustrate one embodiment of the invention including a snow impervious tubular portion having a first generally circular end 11, a second generally circular end 12, outer generally cylindrical surface 13, and inner generally cylindrical surface 14. The protective over-sleeve 10 of FIG. 3 is worn in conjunction with and partially over the glove 15 and coat sleeve 16 of an individual. Glove 15 includes elastic band 16 generally circumscribing glove 15 and bearing against the wrist (not visible) of the individual. Elastic band 18 on end 11 circumscribes and binds end 11 about band 17 of glove 15. Elastic band 19 generally circumscribes and binds end 12 against coat sleeve 16 and the upper forearm (not visible) of the individual. The protective over-sleeve of FIG. 3 is installed by grasping end 12 with the opposite hand and pulling the over-sleeve 10 over glove 15 and coat sleeve 16 to the position illustrated in FIG. 2.

Figure 4:
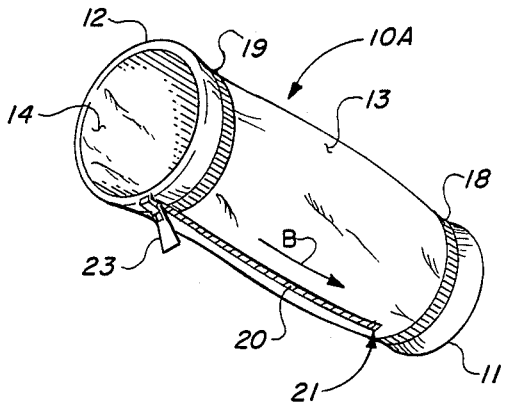
FIG. 4, is a perspective view illustrating another embodiment of the snow-terrain protective clothing of the invention.

One disadvantage of the protective over-sleeve 10 of FIG. 3 is that when it is installed on the arm of an individual, the over-sleeve tends to frictionally force the lower portion of coat sleeve 16 up the forearm and away from the wrist of the individual in the direction of arrow A. This can make proper installation of the protective over-sleeve 10 difficult, particularly if the individual is wearing gloves. This problem is overcome by the embodiment of the invention shown in FIG. 4. Zipper 20 extends from end 12 longitudinally toward end 11. Zipper 20 does not extend completely from end 12 to end 11 because it would be very difficult to install the over-sleeve of FIG. 4 with a single gloved hand. In use, tab 23 of zipper 20 is grasped and pulled in the direction of arrow B down to point 21 to completely open zipper 20 and open the longitudinal split in over-sleeve 10A in which zipper 20 is mounted. The opposite gloved hand of the individual grasps end 12 and pulls over-sleeve 10A over the glove 15 and coat sleeve 16 of the arm of the individual in the direction of arrow A in FIG. 2. Over-sleeve 10A is positioned on the arm of the individual such that elastic band 18 contacts and binds against elastic band 17 of glove 15. Tab 23 is then grasped with the thumb and forefinger of the opposite gloved hand and is pulled toward end 12 of oversleeve 10A to completely close zipper 20. As would be appreciated by those of skill in the art, when the embodiment of the invention illustrated in FIG. 4 is installed, it is unlikely that coat sleeve 16 will be displaced up the forearm in the direction of arrow A due to frictional contact between over-sleeve 10A and coat sleeve 16. Opening zipper 20 prior to installation of over-sleeve 10A tends to minimize any such frictional contact. Zipper 20 is preferably a large YKK zipper which includes a large, readily grasped tab 23 which can be easily operated with a single gloved hand. Small steel zippers are not preferred in use of the invention because they tend to freeze and corrode shut when snow is compacted against the zippers.

Figure 5:
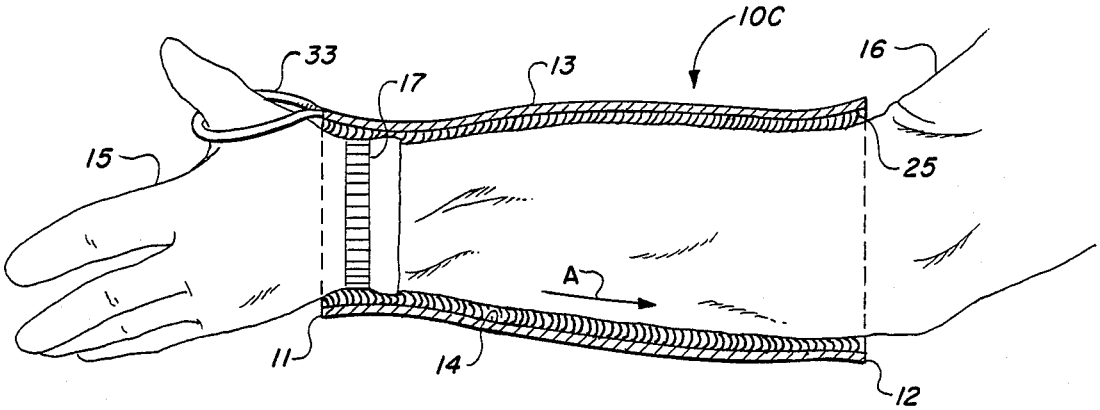
FIG. 5 is a side sectional view of an alternative embodiment of the snow-terrain clothing of the invention.
Figure 6:
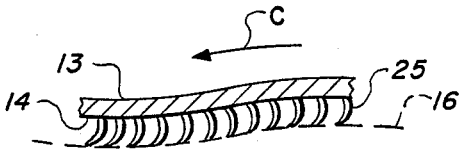
FIG. 6 is a side section view illustrating the mode of operation of the embodiment of the invention illustrated in FIG. 5.
Figure 7:
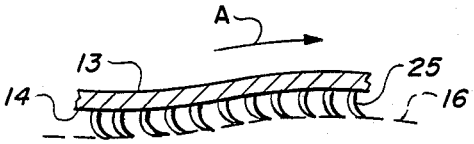
FIG. 7 is a side section view further illustrating the mode of operation of the embodiment of the invention illustrated in FIG. 5.

Another embodiment of the invention is illustrated in FIGS. 5 to 7 and includes elongate semi-rigid elastic hooks 25 attached to inner surface 14 of protective oversleeve 10C. The normal position of hooks 25 is illustrated in FIGS. 5 and 6. In FIGS. 5 and 6, hooks 25 curve toward the wrist of an individual then sleeve 10C is installed on the forearm. Consequently, hooks 25 resist movement of sleeve 10C along sleeve 16 in the direction of arrow C and also resist movement of sleeve 16 in the direction of arrow A with respect to sleeve 10C. Hooks 25 therefore tend to prevent sleeve 10C from sliding down coat sleeve 16 toward glove 15. However, if a strong force pulls sleeve 16 in the direction of arrow A, for example if a skier falls and fully extends his arm, then elastic hooks 26 will elastically bend or give to the orientation shown in FIG. 7. Similarly, if when coat sleeve 16 is generally stationary, sleeve 10C is pulled along sleeve 16 in the direction of arrow C, hooks 25 will elastically bend to the position illustrated in FIG. 7. If after hooks 25 are bent to the positions shown in FIG. 7, sleeve 10C is removed from the arm of the individual or is pulled away from contact with sleeve 16 and glove 15,. then hooks 25 elastically snap back to the normal operative position shown in FIGS. 5 and 6.

Figure 8:
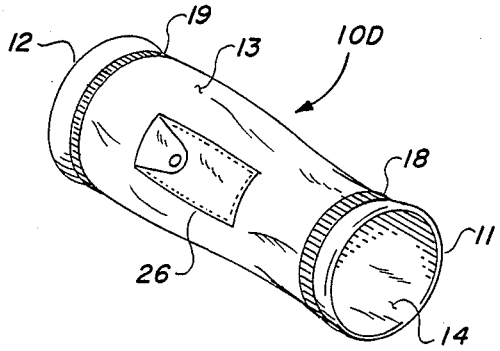
FIG. 8 is a perspective view illustrating still another embodiment of the invention.
Figure 9:
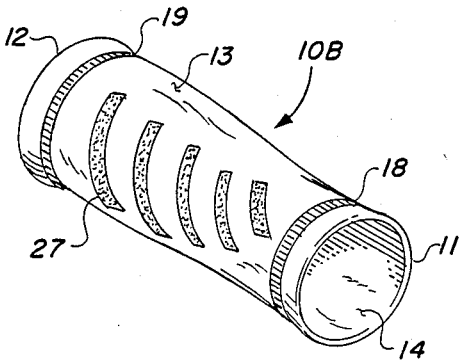
FIG. 9 is a perspective view illustrating yet another embodiment of the invention.

In the embodiment of the over-sleeve 10D illustrated in FIG. 8, a storage pouch 26 is attached to surface 13. In FIG. 9, "armor" strips 27 are attached to surface 13 of oversleeve 10B. There ablative strips protect the forearms of a skier when the skier's arms contact ski poles. Strips 27 are ordinarily fabricated from hard plastic. The tubular portion of over-sleeves 10–10D is preferably fabricated from pack cloth or waterproof nylon and is insulated with terry cloth attached to surface 14. GOR-TEX material can also be utilized in fabricating the tubular pliable portion of over-sleeves 10–10D.

Draw strings or other fastening means can be secured to the pliable fabric portion of sleeves 10–10D in place of elastic bands 18 and 19. Over-sleeves 10–10D can also be worn and utilized to prevent dust particles and various other types of particulate from penetrating the space 30 (FIG. 2) between coat sleeve 16, cuff 32 and the open end 31 of glove 15. A thumb loop 33 (FIG. 5) can be attached to end 11 of an over-sleeve 10–10D to help maintain sleeve 10–10D in position on the forearm of an individual. If desired, sleeve 10–10D can be sized to extend from the wrist of an individual to a position above the elbow of an arm.

Having described my invention in such terms as to enable those skilled in the art to understand and practice it, and having identified the presently preferred embodiment thereof, I claim:

1. A snow sleeve for preventing snow from penetrating between the glove and garment sleeve being worn by an individual, said snow sleeve comprising (a) a snow impervious pliable tubular portion of extended length having outer and inner surfaces and upper and lower ends and adapted to cover the glove and coat sleeve of an individual from the wrist of one of (i) a positioned below the elbow of the arm; and (ii) a position above the elbow of the arm;

(b) wrist engaging elastic means on said lower end of said tubular portion for drawing said lower end of said tubular portion around said glove;

(c) arm engaging elastic means on said upper end of said tubular portion for drawing said upper end of said tubular portion around said garment sleeve about the individual's arm at one of (i) a position below the elbow, and (ii) a position above the elbow, to hold said upper end of said tubular portion in position around said arm;

(d) a longitudinal split spaced apart from said wrist engaging elastic means and intermediate said wrist engaging elastic means and said upper end and opening at and extending from said upper end partially toward said lower end; and, (e) zipper means including a pull tab for closing said split by moving said tab in a direction of travel away from said wrist toward said elbow, said sleeve being readily manually installed on one arm using only the gloved hand of the outer arm and, when pulled over said glove and arm with said zipper means open, being sized to be fit around said garment sleeve without forcing said sleeve up the arm.

2. The snow sleeve of claim 1 wherein said tab can be readily grasped and pulled by said other gloved hand.

3. The snow sleeve of claim 2 wherein said zipper means is resistant to binding and corroding when snow is compacted thereagainst.

4. A method for preventing snow from penetrating between the glove and garment sleeve worn on the hand and arm of a snow skier when the skier falls, said method comprising (a) pulling with the opposite gloved hand a snow sleeve over the wrist of the skier, said snow sleeve including (i) a snow impervious pliable tubular portion of extended length having outer and inner surfaces and upper and lower ends and adapted to cover the glove and garment sleeve from the wrist to one of a position below the elbow of the arm, and a position above the elbow of the arm, (ii) wrist engaging elastic means on said lower end of said tubular portion for drawing said lower end of said tubular portion around said glove, (iii) arm engaging elastic means on said upper end of said tubular portion for drawing said upper end of said tubular portion around said garment sleeve about the individual's arm at one of a position below the elbow of the arm, and a position above the elbow of the arm, to hold said upper end of said tubular portion in position around said forearm, (iv) a longitudinal split spaced apart from said wrist engaging elastic means and intermediate said wrist engaging elastic means and said upper end and opening at and extending from said upper end partially toward said lower end, and (v) open zipper means including a pull tab to close said split by moving said tab in a direction of travel away from said wrist toward said elbow, said sleeve being readily manually installed on one arm using only the gloved hand of the other arm and, when pulled over said gloved and arm with said zipper means open, being sized to minimize frictional contact between said snow sleeve and said arm, (b) positioning said wrist engaging means of said sleeve over and around said glove;

(c) grasping said tab with said other gloved hand; and, (d) drawing with said other gloved hand said tab away from said wrist to close said longitudinal split and draw said sleeve around said forearm and garment sleeve of said skier.

5. The method of claim 4 wherein said tab is shaped and dimensioned to be readily grasped and pulled by said other gloved hand.

6. The method of claim 5 wherein said zipper means is resistant to binding and corroding when snow is compacted thereagainst.

* * * * *